United States Patent [19]

Holzenberger

[11] 4,334,370

[45] Jun. 15, 1982

[54] METHOD OF TRANSPORTING FLOWABLE MEDIA OF CHANGING CONSISTENCIES

[75] Inventor: Kurt Holzenberger, Frankenthal/Pfalz, Fed. Rep. of Germany

[73] Assignee: Klein, Schanzlin & Becker Aktiengesellschaft, Frankenthal/Pfalz, Fed. Rep. of Germany

[21] Appl. No.: 140,967

[22] Filed: Apr. 17, 1980

[30] Foreign Application Priority Data

Apr. 24, 1979 [DE] Fed. Rep. of Germany ..... 2916469

[51] Int. Cl.[3] ..... E02F 3/88

[52] U.S. Cl. ..... 37/195; 37/DIG. 8; 406/14; 406/197; 417/43

[58] Field of Search ..... 37/DIG. 8, 58, 195; 417/43; 406/14, 197

[56] References Cited

U.S. PATENT DOCUMENTS 3,226,854 1/1966 Mero ..... 37/58
3,514,217 5/1970 Reiss ..... 417/43

FOREIGN PATENT DOCUMENTS 2313547 12/1976 France ..... 37/DIG. 8
2358346 2/1978 France ..... 406/14

*Primary Examiner*—Clifford D. Crowder
*Attorney, Agent, or Firm*—Kontler, Grimes & Battersby

[57] ABSTRACT

An arrangement for directly transporting manganese nodules obtained in ocean bottom mining, entrained in carrier water, to a ship includes a riser conduit and a submersible motor-pump arrangement located at the ocean bottom and discharging into the riser conduit in continuous operation. The motor-pump arrangement is so designed and operated that the highest possible pressure reduction therein due to changing consistency of the respective flowable medium minus the pressure differential along the characteristic curve of the pump arrangement at most equals, for all operating points along a characteristic control line, the pressure differential between a continuous operating point and the lowest pressure of the corresponding characteristic curve of the riser conduit at the operating limit.

12 Claims, 4 Drawing Figures

METHOD OF TRANSPORTING FLOWABLE MEDIA OF CHANGING CONSISTENCIES

BACKGROUND OF THE INVENTION

The present invention relates to a method of and an arrangement for transporting flowable media of changing consistencies in general, and more particularly to the control of the operation of submersible motor pumps employed in such arrangements for the direct transportation of solid substances entrained in a carrier liquid, particularly for use in ocean bottom mining of manganese nodules and the like.

A great variety of mechanical and hydraulic conveying or transporting methods is being resorted to at the present time in ocean bottom mining operations for the conveyance or transportation of the obtained minerals. When it is decided to use hydraulic conveyance or transportation, a choice can still be made between the indirect transportation approach, in which the suspension to be transported and/or the carrier liquid is transported to a higher level by means of locks or tubular chambers, and the direct transportation approach for the mined raw materials. In the direct transportation approach, the solid substances mixed with water flow through a suitably designed centrifugal pump, which is usually constructed as a submersible motor pump. When resorting to this kind of transportation, it was heretofore impossible to avoid clogging of the high-pressure port of the pump with the solid substances under certain circumstances.

The operating point of the transportation system is obtained as an intersection of two characteristic curves by entering the corresponding coordinates into a pressure and flow volume diagram. These curves are the respective characteristic curve of resistance of the riser conduit, the pressure loss of which has a minimum at its operating limit, on the one hand, and the characteristic curve of the centrifugal pump, on the other hand. In dependence on the concentration of the solid substance present at any given instant of time in the riser conduit system, both of these characteristic curves change their shapes. As the solid substance concentration in the carrier liquid present in the riser conduit increases, the pressure loss of this riser conduit goes up. In contradistinction thereto, the pressure differential of the centrifugal pump can either rise or fall as the solid substance concentration in the carrier liquid increases, depending on whether the pressure-increasing influence of the density increase caused by the higher solid substance concentration, or the pressure-reducing influence of the elevation head resulting from the higher concentration, especially at larger grain diameters and smaller specific rotational speeds of the pump, prevails. Depending on the circumstances, the characteristic line or curve of the centrifugal pump can change toward lower pressures with either increasing or decreasing concentration of the solid substance in the carrier liquid, and, consequently, the intersection with the riser conduit characteristic curve can be shifted in the direction toward the operating limit and smaller flow volume. In extreme cases, this can result in a back flow of water and of the solid substance entrained therein through the riser conduit. When this happens, the water can flow through the centrifugal pump in the backward direction, yet the entrained solid substance cannot do so due to the centrifugal action of the impeller of the centrifugal pump. This, of course, eventually results in clogging of the high-pressure port of the pump and of the riser conduit. This, of course, is very disadvantageous, especially in view of the fact that the high-pressure port and the riser conduit can be unclogged only by a very cumbersome and time-consuming operation.

OBJECTS AND SUMMARY OF THE INVENTION

Accordingly, it is a general object of the present invention to avoid the disadvantages of the prior art.

More particularly, it is an object of the present invention to provide an arrangement for directly transporting flowable media of changing consistencies which is not possessed of the disadvantages of the conventional arrangements of this type.

Still more particularly, it is an object of the invention to develop a device for use with the centrifugal pumps and transportation arrangements of the aforementioned type which assures constantly reliable transportation during operation and avoids the danger of clogging of the centrifugal pump.

In pursuance of these objects and others which will become apparent hereafter, one feature of the present invention resides in an arrangement for directly transporting flowable media of changing consistencies, especially solid substances such as manganese nodules and the like obtained in ocean bottom mining, entrained at changing concentrations in a carrier liquid, which, briefly stated, comprises riser conduit means and submersible motor pump means discharging into the riser conduit means in continuous operation and so designed that the highest possible pressure reduction therein due to changing consistency of the respective flowable medium minus the pressure differential along the characteristic curve of the pump means at most equals, for all operating points along a characteristic control line, the pressure differential between a continuous operating point and the lowest pressure of the corresponding characteristic curve of the riser conduit means at the operating limit.

Another feature of the present invention resides in a method of directly transporting flowable media of changing consistencies, especially solid substances such as manganese nodules and the like obtained in ocean bottom mining, entrained at changing concentrations in a carrier liquid, which method comprises the steps of so connecting submersible motor pump means to riser conduit means that the former discharges the respective flowable medium into the latter during operation thereof, and so continuously operating the pump means that the operating points thereof are substantially located on a characteristic control line along which the highest possible pressure reduction in the pump means due to changing consistency of the respective flowable medium minus the pressure differential along the characteristic curve of the pump means at least equals the pressure differential between a continuous operating point and the lowest pressure of the corresponding characteristic curve of the riser conduit means at the operating limit.

When this solution is resorted to, the possibility of clogging of the pump and the attendant extended interruption in the operation thereof are effectively avoided. It will be appreciated that, should the discharge port of the pump and the riser conduit become clogged, the pump, inclusive of the riser conduit connected thereto, would have to be pulled out of the water, the clogged passages would have to be cleaned, and the entire assembly would have to be returned to its previous position for continuation of the mining operation. This is a very cumbersome operation, especially in view of the fact that the submersible motor means may be located several hundred or thousand meters below sea level during its operation. A particular advantage of the present invention is that the operating point of the pump can be maintained in the region of the characteristic control line and such clogging can be avoided by resorting to conventional and commercially available control devices, despite the fact that the concentration of the solid substance in the carrier liquid, particularly water, may vary within relatively wide limits.

According to a currently preferred aspect of the present invention, the operating step includes so controlling the speed of the pump means as to bring those operating points of the pump means which deviate from the characteristic control line owing to changes in the consistency of the respective flowable medium onto the characteristic control line. Another facet of the present invention resides in that the operating step includes maintaining the operating points on a simplified characteristic line of constant flow volume, this simplified characteristic line passing through the intersection of the safety limit with the characteristic curve of the riser conduit means corresponding to the highest possible concentration.

The novel features which are considered as characteristic of the invention are set forth in particular in the appended claims. The improved arrangement for directly transporting flowable media of changing consistency, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
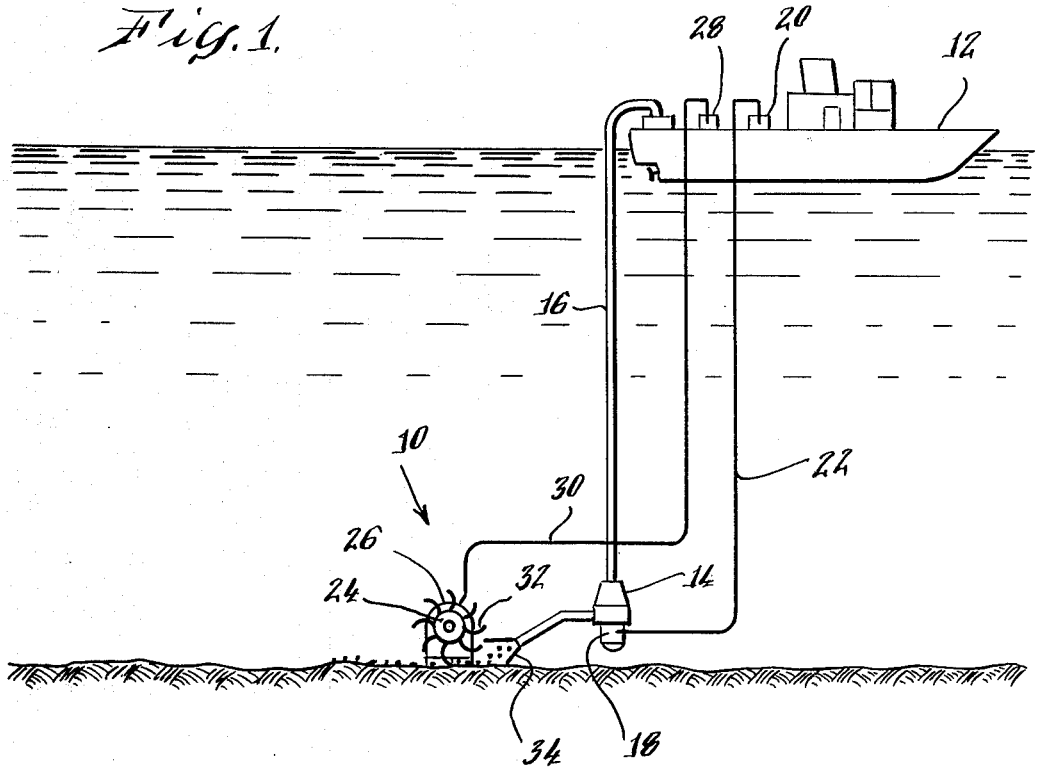
FIG. 1 is a somewhat diagramatic side elevational view of a transporting arrangement according to the present invention as used in an ocean bottom mining installation.

Referring now to the drawing in detail, and first to FIG. 1 thereof, it may be seen that it illustrates a transporting arrangement according to the present invention as being used in ocean bottom mining, such as for manganese nodules and the like. The reference numeral 12 identifies a ship or a similar seafaring vessel, while the reference numeral 10 denotes a mining apparatus which is located at the ocean bottom and feeds manganese nodules or similar raw materials obtained from the ocean bottom to the transporting arrangement of the present invention which transports the raw materials entrained in a carrier liquid which, in this instance, is salt water, to the vessel 12. The transporting arrangement of the present invention includes a centrifugal pump 14 of the submersible type which is driven in rotation by submersible motor 18. The pump 14 and the motor 18 may be, for instance, of the type disclosed in the commonly owned U.S. patent application Ser. No. 101,644 of Paul Rosemann, filed on Dec. 10, 1979 and now abandoned. The pump 14 discharges into a riser conduit 16 constituting another component of the transporting arrangement and leading to the ship 12. A control arrangement 20 is located on the vessel 12 in the illustrated embodiment, but it could just as well be located directly on the motor 18. The arrangement 20 controls the operation of the motor 18, especially the speed of rotation thereof, in the manner which will be discussed in detail below. The connecting cable 22 connects the control arrangement 20 with the motor 18 and supplies the latter with electric power needed for rotating the centrifugal pump 14 and/or with control signals controlling the operation of the motor 18.

The mining arrangement 10 includes a mining tool 24 which is illustrated as having a plurality of blades 32 which pick up the manganese nodules from the ocean bottom and deliver the same into a conduit 34 which communicates with the input port of the pump 14. The mining tool 24 is driven in rotation by a motor 26 the operation of which is controlled by another control arrangement 28 carried by the vessel 12, via a control cable 30 which also supplies power to the motor 26. The particular mining arrangement 10 shown in the drawing is illustrative only and it will be appreciated that any other suitable mining arrangement could be used instead.

Figure 2:
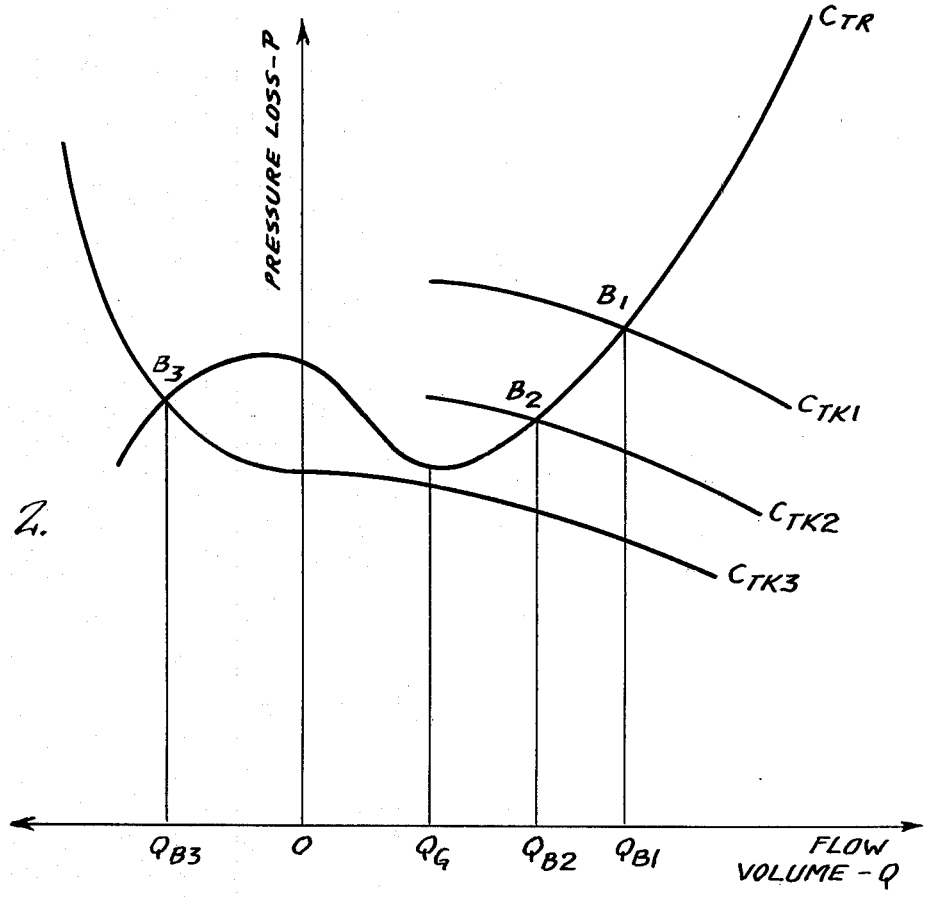
FIG. 2 is a diagram illustrating the characteristic behavior of a submersible motor pump and of a riser conduit for varying consistencies of the flowable medium being transported.

Turning now to FIG. 2, it may be seen that it is a diagram in which the flow volume Q per unit of time is indicated on the x-axis, while the pressure loss p is entered on the y-axis. This diagram illustrates the operating behavior of the conventional centrifugal pumps, such as submersible motor pumps. A line $C_{TR}$ indicates the characteristic curve of the resistance of the riser conduit system. It will be appreciated that this curve $C_{TR}$ continues beyond the minimum flow volume $Q_G$ toward lower flow volumes, and that it reaches into the region of negative flow volume or backflow. FIG. 2 also illustrates characteristic lines $C_{TK1}$, $C_{TK2}$ and $C_{TK3}$ of the centrifugal pump for different concentrations of solid substances or particles entrained in the carrier liquid.

As can be ascertained from FIG. 2, the characteristic curve $C_{TK3}$ intersects the riser conduit characteristic line $C_{TR}$ at a point $B_3$ which is no longer located in the region of the positive flow volume Q. As a matter of fact, the flow volume $Q_{B3}$ corresponding to the point $B_3$ is in the region of negative flow or back flow. This situation could arise, for instance, when an extended stretch of carrier liquid of a low concentration $C_{TR}$ is present in the riser conduit downstream of the pump, while the pump temporarily pumps a flowable medium having a higher concentration $C_{TK3}$. Inasmuch as the characteristic curve $C_{TK3}$ of the pump intersects the characteristic curve $C_{TR}$ of the riser conduit at the point $B_3$ which is located in the region of the negative flow volume, the flowable medium present in the conduit would flow back toward the pump. Under these circumstances, the carrier liquid, that is, salt water, can flow backwardly through the pump, but the solid particles entrained by the carrier liquid will be prevented from passing through the pump in the backward direction by the centrifugal action of the impeller of the pump, so that these solid particles would accumulate at and eventually clog the high-pressure discharge port of the pump and the riser conduit.

Figure 3:
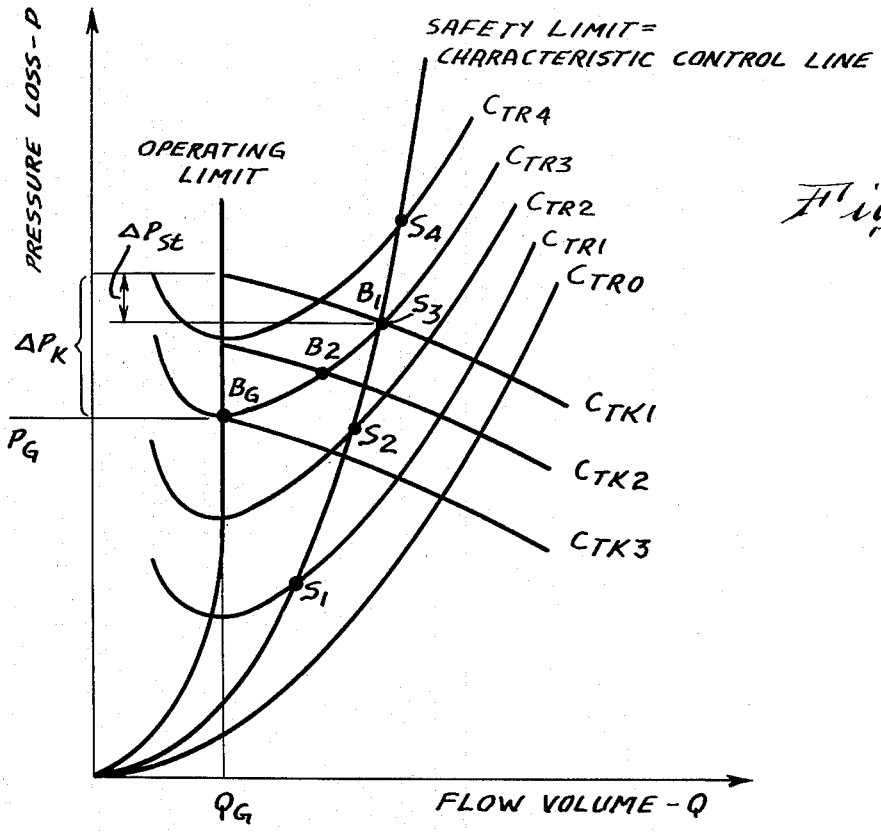
FIG. 3 is a diagram similar to that of FIG. 2 but showing the solution according to the present invention.

Turning now to FIG. 3, it may be seen that it illustrates, in a diagrammatic form, the solution according to the present invention. This Figure again shows various riser conduit characteristic curves $C_{TR0}$ to $C_{TR4}$, wherein the characteristic curve $C_{TR0}$ represents a situation where only the carrier liquid, without any solid inclusions therein, is present in the riser conduit 16, while the characteristic curve $C_{TR4}$ represents the highest concentration of the solid particles in the carrier liquid present in the riser conduit 16 as a result of the operation of the mining arrangement 10. The characteristic curves $C_{TR1}$ to $C_{TR3}$ are representative of different intermediate concentrations of the solid particles in the carrier liquid present in the riser conduit 16. When the user of the transporting arrangement of the present invention starts from an average concentration $C_{TR3}$ prevailing in the riser conduit 16, then the respective characteristic curve of the pump 14, of which 3 are shown as $C_{TK1}$, $C_{TK2}$, and $C_{TK3}$ in FIG. 3, must intersect the riser conduit characteristic of $C_{TR3}$ only in the region curve the positive flow volume Q, in order to safely avoid the backflow of the solid particles being transported and the resulting clogging of the pump 14 and of the riser conduit 16. Thus, at a predetermined concentration of the solid particles in the carrier liquid present in the riser conduit 16, the intersection of the riser conduit characteristic curve $C_{TR3}$ with the pump characteristic line $C_{TK3}$ would constitute the operating limit at the point $B_G$. Under these circumstances, there would still be provided a positive flow volume $Q_G$ at a pressure $P_G$.

In normal operation, the submersible pump 14 discharges the flowable medium with a concentration $C_{TK1}$ into the riser conduit 16 in which the concentration is $C_{TR3}$, that is, at the point $B_1$ of FIG. 3. Now, should the concentration in the centrifugal pump 14 change from $C_{TK1}$ to $C_{TK2}$, then the operating point travels toward $B_2$, for all intents and purposes, along the riser conduit characteristic curve $C_{TR3}$, inasmuch as the concentration in the riser conduit 16 remains virtually the same, at least temporarily. The concentration of the solid particles in the carrier liquid within the pump 14 may be changed only to the value $C_{TK3}$ in order to safely maintain the operation at the limiting operating point $B_G$. If the solid particle concentration in the carrier liquid were permitted to drop below this value, then the operating point would jump over into the region of the negative flow volume, as explained in connection with FIG. 2, and this would result in clogging of the pump 14 and of the riser conduit 16.

In order to safely avoid the occurrence of this disadvantageous situation, the largest concentration change $\Delta C_{TK}$ which can occur during the operation, that is, the largest solid particle concentration $C_{TR\,max}$ supplied by the mining tool 10 from the ocean bottom, must be used for designing the pump 14. The largest pressure differential $\Delta p_K$ in the centrifugal pump 14 can be determined from this largest deliverable concentration $C_{TR\,max}$, from the characteristic data of the pump 14, from the diameter, and from the respective density or specific weight of the minerals, ores or manganese nodules to be transported. Now, when this pressure differential $\Delta p_K$ is added to the minimum pressure $p_G$ of the riser conduit characteristic curve $C_{TR3}$ at the operating limit, that is, at the limiting operating point $B_G$ situated vertically upwardly of $Q_G$, then a pump characteristic curve can be entered from this point, decreasing in the rightward direction, to its intersection with the riser conduit characteristic curve $C_{TR3}$. This intersection $B_1$ is then a point of a safety limit which is obtained as a connecting line of all of those intersecting points which are constructed in the same manner for other concentrations $C_{TR}$. In FIG. 3, the decrease in the pump characteristic curve between the operating limit and the point $B_1$ is indicated as a pressure differential $\Delta p_{st}$ of the centrifugal pump characteristic curve $C_{TK1}$.

The intersection points S1, S2, S3, and S4, are located on and determinative of the shape of the safety limit for the chosen application of the present invention. It may be seen that the intersection point S3 is identical with the point $B_1$. The actual operating points of the submersible motor pump 14 then must be located outwardly, that is, rightwardly, of this safety limit in order to safely avoid clogging of the high-pressure discharge port of the pump 14 by returning solid particles. However, the farther the actual operating pump is moved rightwardly from the safety limit into the region of higher flow volumes Q, the less economical is the operation of the transporting arrangement. This is caused by the increasing speed of flow of the flowable substance through the lengthy riser conduit 16 and the attendant increase in the resistance to flow in this riser conduit 16. Consequently, there exists a pronounced economical interest in putting the actual operating point as close as possible to the safety limit without sacrificing the safety of the operation, and to bring the actual operating point back to this safety limit by means of the control arrangement 20 which is of a conventional construction. Variation of the speed of rotation of the centrifugal pump 12 constitutes an ideal control approach under these circumstances, inasmuch as it can be achieved, for instance, by changing, in a simple manner, the frequency of the alternating current supplied via the line 22 to the motor 18.

Figure 4:
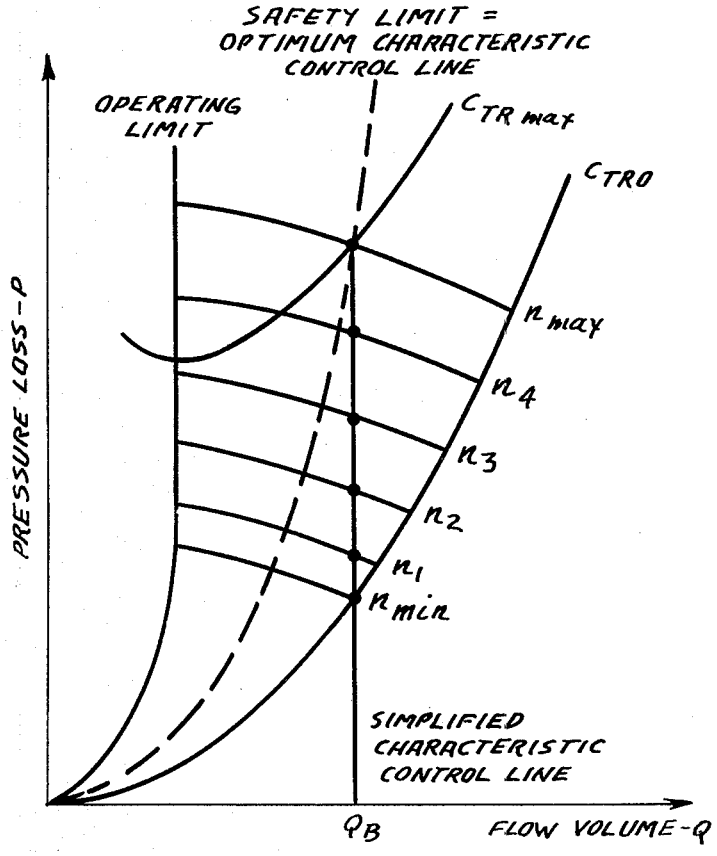
FIG. 4 is a diagram similar to that of FIG. 3 but showing a simplified solution according to the present invention.

FIG. 4 illustrates another, simplified, characteristic control line for controlling the operation of the centrifugal pump 14. Any operating points which deviate from this characteristic control line are brought back to this characteristic control line by changing the speed of rotation of the pump 14. An optimum characteristic control line, which is identical with the safety limit, and which achieves the highest degree of economy without sacrificing the necessary operational safety, can be followed, for instance, by storing pairs of associated values, for instance, consisting of flow volume Q and pump pressure differential p. A simplified characteristic control line is obtained by using a line of constant flow volume $Q_B$. The upper limiting point of this simplified characteristic control line is constituted by the intersection of the safety limit with the riser conduit characteristic curve of the highest concentration $C_{TR\,max}$, and it simultaneously determines the highest rotational speed $n_{max}$ of the pump 14. This control is simpler than that explained before inasmuch as each measurable deviation from a predetermined flow volume $Q_B$ can be used as a command pulse for controlling the speed of rotation of the pump 14. Of necessity, this simplified control involves a small decrease in the efficiency and causes a minute increase in the throughput of the transporting arrangement.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of transporting a flowable medium in a carrier fluid, especially a flowable solid such as manganese nodules and the like obtained in ocean bottom mining, comprising conveying said medium and fluid from a pressurized source of the same along an ascending path at least generally in accordance with a characteristic control line along which the following relation is satisifed:

$$\Delta p_1 - \Delta p_2 \leqq \Delta p_3$$

where

- $\Delta p_1$ is the calculated maximum possible pressure reduction in said source corresponding to the largest possible change in the concentration of said medium in said fluid,
- $\Delta p_2$ is the pressure differential along a characteristic curve of said source between a predetermined operating point corresponding to a characteristic curve of said path and the intersection with a line of constant flow passing through a minimum of said characteristic curve of said path, and
- $\Delta p_3$ is the pressure differential between said predetermined operating point and said minimum.

2. A method as defined in claim 1, said source being rotatable; and wherein said conveying comprises regulating the rotational speed of said source.

3. A method as defined in claim 1, comprising measuring at least one of the parameters pressure and flow, but not the concentration of said medium in said fluid, to thereby regulate said conveying.

4. A method as defined in claim 1, comprising correcting for deviations from said characteristic control line.

5. A method as defined in claim 1, wherein said characteristic control line is a line of constant flow and the latter is determined by the intersection of an optimum characteristic control line with the characteristic curve of said path corresponding to the maximum concentration of said medium in said fluid.

6. A method as defined in claim 1, wherein said fluid comprises a liquid.

7. A method as defined in claim 6, wherein said pressurized source is submerged in said liquid and said path extends from said pressurized source to above the surface of said liquid.

8. A method as defined in claim 7, wherein said liquid is ocean water and said medium is a substance located at the ocean bottom.

9. A method as defined in claim 1, wherein said path is generally vertical.

10. A method as defined in claim 1, wherein said conveying is performed continuously.

11. A method as defined in claim 1, wherein said conveying is performed at least generally in accordance with said characteristic control line by measuring the flow of said medium and fluid.

12. A method as defined in claim 1, wherein said conveying is performed at least generally in accordance with said characteristic control line by measuring the pressure differential in said source and the flow of said medium and fluid.

* * * * *